US009812120B2

(12) United States Patent
Takatsuka

(10) Patent No.: US 9,812,120 B2
(45) Date of Patent: Nov. 7, 2017

(54) SPEECH SYNTHESIS APPARATUS, SPEECH SYNTHESIS METHOD, SPEECH SYNTHESIS PROGRAM, PORTABLE INFORMATION TERMINAL, AND SPEECH SYNTHESIS SYSTEM

(75) Inventor: Susumu Takatsuka, Tokyo (JP)

(73) Assignee: Sony Mobile Communications Inc., Tokyo (JP)

( * ) Notice: Subject to any disclaimer, the term of this patent is extended or adjusted under 35 U.S.C. 154(b) by 1323 days.

(21) Appl. No.: 12/411,031

(22) Filed: Mar. 25, 2009

(65) Prior Publication Data

US 2009/0271202 A1 Oct. 29, 2009

(30) Foreign Application Priority Data

Apr. 23, 2008 (JP) ..... 2008-113202

(51) Int. Cl.
*G10L 13/00* (2006.01)
*G10L 13/033* (2013.01)
(Continued)

(52) U.S. Cl.
CPC ..... *G10L 13/033* (2013.01); *G10L 13/027* (2013.01)

(58) Field of Classification Search
USPC ..... 704/258, 260, 243, 235, 204, 270; 709/206; 379/88.03, 88.13; 455/566,
(Continued)

(56) References Cited

U.S. PATENT DOCUMENTS 7,027,981 B2 * 4/2006 Bizjak ..... H03G 3/3089 381/106
7,191,131 B1 3/2007 Nagao
(Continued)

FOREIGN PATENT DOCUMENTS

EP 1 168 300 A1 1/2002
GB 2 343 821 A 5/2000
(Continued)

OTHER PUBLICATIONS

Yoichi Yamashita, et al., "Dialog Context Dependencies of Utterances Generated from Concept Reperesentation", ICSLP 94: 1994 International Conference on Spoken Language Processing, vol. 2, XP000855413, Sep. 18, 1994, pp. 971-974.
(Continued)

*Primary Examiner* — Neeraj Sharma
(74) *Attorney, Agent, or Firm* — Oblon, McClelland, Maier & Neustadt, L.L.P.

(57) ABSTRACT

A speech synthesis apparatus includes a content selection unit that selects a text content item to be converted into speech; a related information selection unit that selects related information which can be at least converted into text and which is related to the text content item selected by the content selection unit; a data addition unit that converts the related information selected by the related information selection unit into text and adds text data of the text to text data of the text content item selected by the content selection unit; a text-to-speech conversion unit that converts the text data supplied from the data addition unit into a speech signal; and a speech output unit that outputs the speech signal supplied from the text-to-speech conversion unit.

17 Claims, 3 Drawing Sheets

(51) Int. Cl.

| | |
|---|---|
| ***G10L 13/027*** | (2013.01) |
| *G10L 15/00* | (2013.01) |
| *G10L 21/00* | (2013.01) |
| *G06F 17/30* | (2006.01) |
| *H04M 1/64* | (2006.01) |
| *H04M 11/00* | (2006.01) |
| *G06F 3/00* | (2006.01) |
| *G06F 17/20* | (2006.01) |
| *G06F 17/28* | (2006.01) |
| *G06F 15/16* | (2006.01) |
| *H04B 1/38* | (2015.01) |
| *H04M 1/00* | (2006.01) |

(58) Field of Classification Search
USPC ..... 455/550.1; 715/744, 236, 205; 707/102
See application file for complete search history.

(56) References Cited

U.S. PATENT DOCUMENTS

| | | | | |
|---|---|---|---|---|
| 7,324,942 | B1 * | 1/2008 | Mahowald | G10L 17/22 704/251 |
| 7,415,409 | B2 * | 8/2008 | Simoneau et al. | 704/243 |
| 7,742,924 | B2 * | 6/2010 | Miyata | G06F 17/2785 704/270 |
| 7,809,117 | B2 * | 10/2010 | Runge et al. | 379/88.13 |
| 7,870,142 | B2 * | 1/2011 | Michmerhuizen et al. | 707/755 |
| 8,000,453 | B2 * | 8/2011 | Cooper et al. | 379/88.03 |
| 8,326,343 | B2 * | 12/2012 | Lee | G10L 13/00 348/14.01 |
| 2002/0188449 | A1 * | 12/2002 | Nukaga | G10L 13/10 704/258 |
| 2003/0023688 | A1 * | 1/2003 | Denenberg et al. | 709/206 |
| 2004/0030554 | A1 * | 2/2004 | Boxberger-Oberoi et al. | 704/260 |
| 2005/0022115 | A1 * | 1/2005 | Baumgartner | G06F 17/30911 715/205 |
| 2005/0107127 | A1 * | 5/2005 | Moriya | 455/566 |
| 2005/0197842 | A1 * | 9/2005 | Bergmann et al. | 704/270.1 |
| 2006/0161850 | A1 * | 7/2006 | Seaberg | G06F 17/248 715/744 |
| 2006/0190804 | A1 * | 8/2006 | Yang | G06F 17/248 715/236 |
| 2007/0050188 | A1 * | 3/2007 | Blair et al. | 704/207 |
| 2008/0059189 | A1 * | 3/2008 | Stephens | 704/258 |
| 2009/0055187 | A1 * | 2/2009 | Leventhal et al. | 704/260 |
| 2009/0259472 | A1 * | 10/2009 | Schroeter | 704/260 |
| 2009/0319267 | A1 * | 12/2009 | Kurki-Suonio | 704/235 |

FOREIGN PATENT DOCUMENTS

| | | | |
|---|---|---|---|
| JP | 9-307658 | A | 11/1997 |
| JP | 10-290256 | A | 10/1998 |
| JP | A 2000-250574 | | 9/2000 |
| JP | 2001-5688 | | 1/2001 |
| JP | 2001-109487 | A | 4/2001 |
| JP | 2001-117828 | A | 4/2001 |
| JP | 2001-236205 | A | 8/2001 |
| JP | 2001-325191 | A | 11/2001 |
| JP | 2002-23782 | A | 1/2002 |
| JP | 2002-354111 | | 12/2002 |
| JP | 2003-223181 | | 8/2003 |
| JP | 2004-198488 | A | 7/2004 |
| JP | 2004-240217 | A | 8/2004 |
| JP | 2005-43968 | A | 2/2005 |
| JP | 2005-106905 | | 4/2005 |
| JP | 2005-221289 | A | 8/2005 |
| JP | 2006-323827 | | 11/2006 |
| JP | A 2007-004280 | | 1/2007 |
| JP | 2007-087267 | | 4/2007 |
| JP | 2007-293277 | | 11/2007 |
| WO | WO 99/66496 | | 12/1999 |

OTHER PUBLICATIONS

Japanese Office Action issued in Japanese Patent Application No. 2008-113202 dated May 22, 2012.
Office Action dated Nov. 6, 2012 in Japanese Patent Application No. 2008-113202.
Japanese Office Action issued in corresponding Japanese Patent Application No. 2008-113202, dated of Jun. 18, 2013.
Japanese Office Action dated Oct. 15, 2013 in Patent Application No. 2008-113202.

* cited by examiner

SPEECH SYNTHESIS APPARATUS, SPEECH SYNTHESIS METHOD, SPEECH SYNTHESIS PROGRAM, PORTABLE INFORMATION TERMINAL, AND SPEECH SYNTHESIS SYSTEM

BACKGROUND OF THE INVENTION

1. Field of the Invention

The present invention relates to a speech synthesis apparatus, a speech synthesis method, a speech synthesis program, a portable information terminal, and a speech synthesis system that are desirable in a case where various effects are added to, for example, speech that is converted from text data.

2. Description of the Related Art

As one of functions realized by a personal computer or a game machine, there is a function of outputting a speech signal from a speaker, the speech signal being converted from text data. This function is a so-called reading-aloud function.

There are roughly two types of methods for performing text-to-speech conversion used in this reading-aloud function.

One of the two types of methods is speech synthesis by filing and editing, and the other is speech synthesis by rule.

The speech synthesis by filing and editing is a method for synthesizing a desired word, sentence, or the like by performing editing such as combination of pre-recorded speech items such as words or the like uttered by a human. Here, in the speech synthesis by filing and editing, although the resulting speech sounds natural and is close to human speech, since desired words, sentences, and the like are generated by combining pre-recorded speech items, it may not be possible to generate some words or sentences using the pre-recorded speech items. Moreover, for example, when this speech synthesis by filing and editing is applied to a case in which some fictional characters read text aloud, a plurality of sets of speech data of different timbres (voice timbres) as many as the number of the fictional characters are necessary. In particular, for a high-quality timbre, for example, additional speech data of 600 MB per fictional character is necessary.

In contrast, the speech synthesis by rule is a method for synthesizing speech by combining elements such as "phonemes" and "syllables" constituting speech. The degree of freedom of this speech synthesis by rule is high since elements such as "phonemes" and "syllables" can be freely combined. Moreover, since pre-recorded speech data to be material is not necessary, for example, this speech synthesis by rule is suitable for a speech synthesis function for an application installed onto a device whose built-in memory is not sufficiently large such as a portable information terminal. Here, compared with the above-described speech synthesis by filing and editing, synthesized speech obtained by means of the speech synthesis by rule tends to be machine-voice-like speech.

In addition, for example, Japanese Unexamined Patent Application Publication No. 2001-51688 discloses an e-mail reading-aloud apparatus using speech synthesis in which speech corresponding to text of an e-mail message is synthesized using text information concerning the e-mail message, music and sound effects are added to the synthesized speech, and resulting synthesized speech is output.

Moreover, for example, Japanese Unexamined Patent Application Publication No. 2002-354111 discloses a speech-signal synthesis apparatus and the like that synthesize speech input from a microphone and background music (BGM) played back from a BGM recording unit and output a resulting speech signal from a speaker or the like.

Moreover, for example, Japanese Unexamined Patent Application Publication No. 2005-106905 discloses a speech output system and the like that convert text data included in an e-mail message or a website into speech data, convert the speech data into a speech signal, and output the speech signal from a speaker or the like.

Moreover, for example, Japanese Unexamined Patent Application Publication No. 2003-223181 discloses a text-to-speech conversion apparatus and the like that divide text data into pictographic-character data and other character data, convert the pictographic-character data into intonation control data, convert the other character data into a speech signal having intonation based on the intonation control data, and output the speech signal from a speaker or the like.

Moreover, Japanese Unexamined Patent Application Publication No. 2007-293277 discloses an RSS content management method and the like that extract text from RSS content and convert the text into speech.

SUMMARY OF THE INVENTION

Here, in the above-described existing technologies for performing text-to-speech conversion, text data is merely converted into a speech signal and the speech signal is merely played back. Thus, the speech that is played back and output is machine-voice-like speech and not attractive.

For example, the speech synthesis by filing and editing provides speech that sounds natural and is close to human speech; however, the speech is obtained by simply converting text, whereby the speech is not attractive. Moreover, the speech synthesis by rule has a disadvantage in that speech tends to be machine-voice-like speech and sounds poorly.

On the other hand, as described in the above-described Japanese Unexamined Patent Application Publications, there is a technology in which some effect can be added to speech by adding BGM or intonation; however, such an added effect is not beneficial to listeners on every occasion.

It is desirable to provide a speech synthesis apparatus, a speech synthesis method, a speech synthesis program, a portable information terminal, and a speech synthesis system that can output attractive speech that gives listeners a pleasing impression that speech is not merely converted from subject text can be obtained and output, in a case where, for example, a speech signal converted from text data is played back and output.

Moreover, it is desirable to provide a speech synthesis apparatus, a speech synthesis method, a speech synthesis program, a portable information terminal, and a speech synthesis system that are capable of outputting played back speech on which effects or the like that are beneficial to a certain level to listeners have been added.

According to an embodiment of the present invention, a text content item to be converted into speech is selected, related information which can be at least converted into text and which is related to the selected text content item is selected, the related information is converted into text, and text data of the text is added to text data of the selected text content item. Then, resulting text data is converted into a speech signal, and the speech signal is output.

That is, according to an embodiment of the present invention, when a text content item is selected, related information related to the text content item is also selected. The related information is converted into text, text data of the text is added to text data of the selected text content item, and text-to-speech conversion is performed on resulting text data. In other words, according to the embodiment of the present invention, text data is not merely converted into speech. Text data to which an effect according to the related information and the like are added is converted into speech.

According to an embodiment of the present invention, a text content item to be converted into speech is selected, related information which is related to the selected text content item is converted into text, and text data of the text is added to text data of the selected text content item. Resulting data is converted into a speech signal and the speech signal is output. Thus, according to an embodiment of the present invention, for example, in a case where a speech signal converted from text data is played back and output, attractive speech that gives listeners a pleasing impression that speech is not merely converted from subject text can be obtained and output. Moreover, according to an embodiment of the present invention, speech on which effects or the like that are beneficial to a certain level to listeners have been added can be output.

DESCRIPTION OF THE PREFERRED EMBODIMENTS

In the following, an embodiment of the present invention will be described with reference to the attached drawings.

Here, the embodiment of the present invention is an example, and thus, as a matter of course, a mere embodiment of the present invention is not limited to this example.

Figure 1:
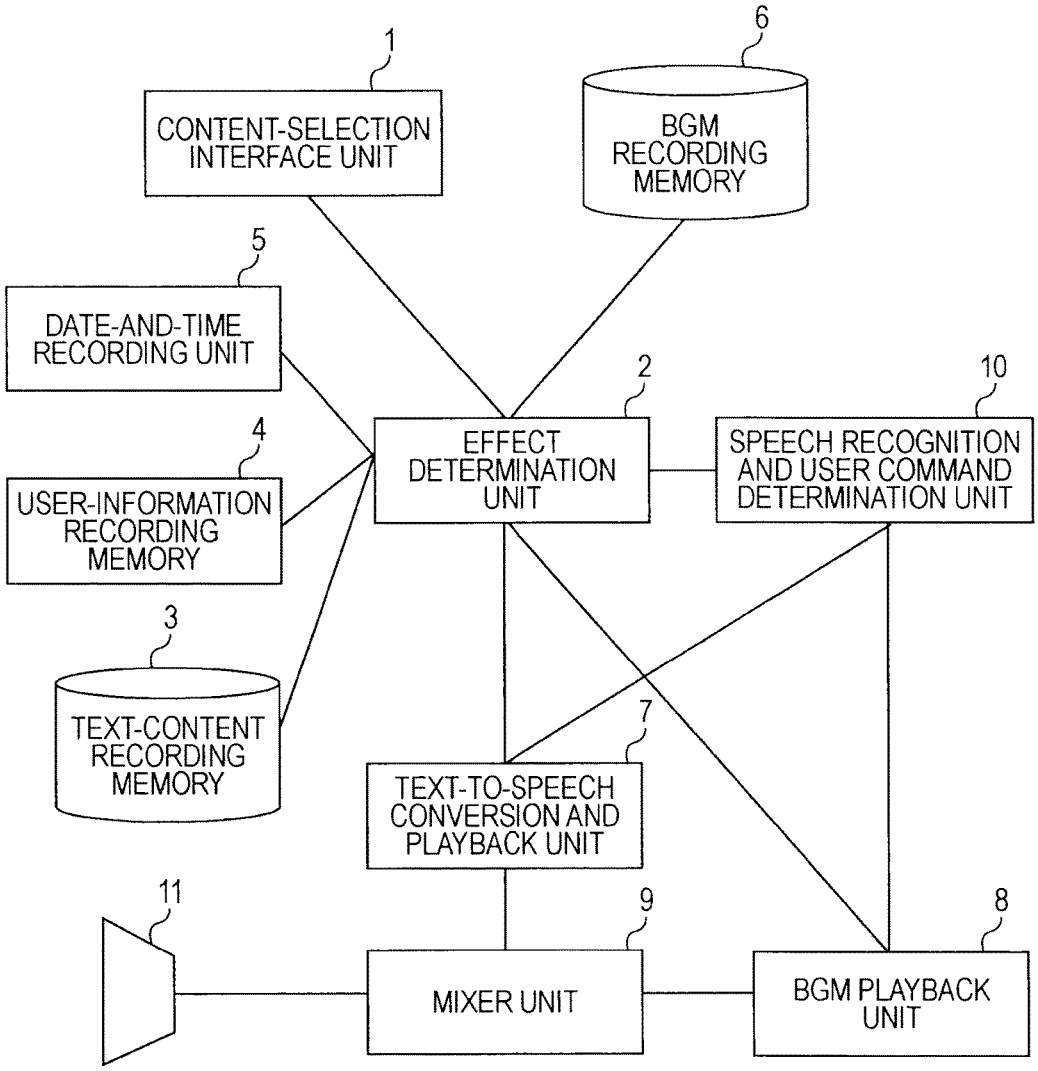
FIG. 1 is a block diagram showing an example of a schematic internal structure of a speech synthesis apparatus according to an embodiment of the present invention.

FIG. 1 shows an example of a schematic internal structure of a speech synthesis apparatus according to the embodiment of the present invention.

Here, the speech synthesis apparatus according to the embodiment of the present invention can be applied to not only various stationary devices but also various mobile devices such as a portable telephone terminal, a personal digital assistant (PDA), a personal computer (for example, a laptop computer), a navigation apparatus, a portable audio-visual (AV) device, a portable game machine, and the like. Moreover, the speech synthesis apparatus according to the embodiment of the present invention may be a speech synthesis system whose components are individual devices. In this embodiment, a portable telephone terminal is used as an exemplary device to which the speech synthesis apparatus can be applied. Moreover, a method for converting text into speech in this embodiment can be applied to both speech synthesis by filing and editing and speech synthesis by rule; however, this embodiment is particularly suitable in a case of making machine-voice-like synthesized speech obtained in speech synthesis by rule to be more attractive.

A portable telephone terminal according to the embodiment shown in FIG. 1 includes a content-selection interface unit 1, an effect determination unit 2, a text-content recording memory 3, a user-information recording memory 4, a date-and-time recording unit 5, a BGM recording memory 6, a text-to-speech conversion and playback unit 7, a BGM playback unit 8, a mixer unit 9, a speech recognition and user command determination unit 10, and a speaker or a headphone 11.

For example, data (particularly text data) of various text content items such as e-mail messages, a user schedule, cooking recipes, guide (navigation) information, and information concerning news, weather forecast, stock prices, a television timetable, web pages, web logs, fortune telling, and the like that are downloaded through the Internet or the like is recorded in the text-content recording memory 3. Here, in the following description, the data of a text content item may be simply referred to as a text content item or a content item. The above-described text content items are mere examples, and other various text content items are also recorded in the text-content recording memory 3.

Pieces of user information related to the text content items recorded in the text-content recording memory 3 are recorded in the user-information recording memory 4. Each piece of user information is related to a text content item recorded in the text-content recording memory 3 in accordance with settings set in advance by a user, settings set in advance on a per-content basis, settings set by a programmer of a speech synthesis program to be described below, or the like. Moreover, in a case where user information is included in advance within a text content item, it may not be necessary to relate the text content item to the user information in advance. Here, examples of user information related to a text content item are information that can be expressed at least in text, for example, the name of a user of a subject portable telephone terminal, the name of a sender of an e-mail message, and names of participants in a planned schedule. As a matter of course, there may be some text content items that are not related to any user information.

Pieces of date-and-time information related to the text content items recorded in the text-content recording memory 3 are recorded in the date-and-time recording unit 5. Each piece of date-and-time information is related to a text content item recorded in the text-content recording memory 3 in accordance with settings set in advance by a user, settings set in advance on a per-content basis, settings set by a programmer of a speech synthesis program to be described below, or the like. Here, examples of date-and-time information related to a text content item are date-and-time information regarding the current date and time and the like. Moreover, another example of the date-and-time information is unique date-and-time information on a per-content basis. Examples of the unique date-and-time information are information that can be at least converted into text, for example, information regarding a distribution date and time of distributed news or the like in a case of news, information regarding a date and time of a schedule or the like in a case of a scheduler, and information regarding a reception or transmission date and time of an e-mail message or the like in a case of an e-mail message. As a matter of course, there may be some text content items that are not related to any date-and-time information.

A plurality of pieces of BGM data are recorded in the BGM recording memory 6. The pieces of the BGM data within the BGM recording memory 6 are divided into pieces of BGM data related to and pieces of BGM data not related to the text content items recorded in the text-content recording memory 3. Each piece of the BGM data is related to a text content item recorded in the BGM recording memory 6 in accordance with settings set in advance by a user, settings set in advance on a per-content basis, settings set by a programmer of a speech synthesis program, or the like. Moreover, each piece of the BGM data may be randomly related to a text content item recorded in the BGM recording memory 6. Whether the pieces of the BGM data are to be randomly related to the text content items may be set in advance. Moreover, when the content-selection interface unit 1 selects a text content item, the text content item may be randomly and automatically related to one of the pieces of the BGM data as described below.

The speech recognition and user command determination unit 10 performs speech recognition on speech of a user input through a microphone, and determines details of a command input by the user using the speech recognition result.

The content-selection interface unit 1 is an interface unit for allowing a user to select a desired content item from the text content items recorded in the text-content recording memory 3. A desired content item can be directly selected by a user from the text content items recorded in the text-content recording memory 3 or automatically selected when an application program within a subject portable telephone terminal is started in accordance with a start command input by a user. Here, when a user inputs a select command, for example, a menu for selecting a content item from among a plurality of content items is displayed on a display screen. When a user inputs, from the menu, a select command to select a desired content item through, for example, a key operation or a touch panel operation, the content-selection interface unit 1 selects the desired content item. In a case where a content item is selected in accordance with start of an application, for example, when a user selects an icon for starting an application from among a plurality of icons for starting applications on the display screen and the application is started, a content item is selected. Moreover, a content item may be selected using speech on which speech recognition has been performed. In this case, the speech recognition and user command determination unit 10 performs speech recognition with respect to a user and determines details of a command input by the user using the speech recognition result. The command whose details have been determined in accordance with the speech recognition is sent to the content-selection interface unit 1. Thus, the content-selection interface unit 1 selects a content item in accordance with the command, which has been vocally input by the user.

The effect determination unit 2 executes a speech synthesis program according to an embodiment of the present invention and obtains, from the text-content recording memory 3, the text content item selected by the user through the content-selection interface unit 1. Here, the speech synthesis program according to the embodiment of the present invention may be installed in advance on an internal memory or the like of a portable telephone terminal before the portable telephone terminal is shipped. The speech synthesis program may also be installed onto the internal memory or the like via, for example, a disc-shaped recording medium, an external semiconductor memory, or the like. The speech synthesis program may also be installed onto the internal memory or the like, for example, via a cable connected to an external interface or via wireless communication.

At the same time, the effect determination unit 2 selects user information, date-and-time information, BGM information, and the like related to the selected text content item. That is, when the content-selection interface unit 1 selects a text content item, if there is user information related to the selected text content item, the effect determination unit 2 obtains the user information from the user-information recording memory 4. Moreover, if there is date-and-time information related to the selected text content item, the effect determination unit 2 obtains the date-and-time information from the date-and-time recording unit 5. Similarly, if there is BGM data related to the selected text content item, the effect determination unit 2 obtains the BGM data from the BGM recording memory 6. Here, when the text content items are randomly related to pieces of BGM data, the effect determination unit 2 randomly obtains BGM data from the BGM recording memory 6.

The effect determination unit 2 adds effects to the selected text content item using the user information, the date-and-time information, and the BGM data.

That is, for example, the user information is converted into text data such as a user name or the like. Similarly, the date-and-time information is converted into text data such as a date and time. The text data of the user name, the text data of the date and time, and the like are added to, for example, the top, middle, or end of the selected text content item as necessary.

When the text data of the text content item, the user name, and the date and time is supplied from the effect determination unit 2, the user name and the date and time having been added as effects to the text content item, the text-to-speech conversion and playback unit 7 converts the text data into a speech signal. Then, the speech signal obtained as a result of text-to-speech conversion is output to the mixer unit 9.

Moreover, when the BGM data is supplied from the effect determination unit 2, the BGM playback unit 8 generates a BGM signal (a music signal) from the BGM data.

When the speech signal obtained as a result of text-to-speech conversion is supplied from the text-to-speech conversion and playback unit 7 and the BGM signal is supplied from the BGM playback unit 8, the mixer unit 9 mixes the speech signal and the BGM signal and outputs a resulting signal to a speaker or headphone (hereinafter referred to as a speaker 11).

Thus, speech obtained by mixing speech converted from text and BGM is output from the speaker 11. That is, in this embodiment, the output speech is not just the mixture of the speech converted from text data of the selected text content item and the BGM. For example, the output speech includes speech converted from the text data such as a user name and a date and time, and the like as effects. The user name, date and time, and the like are related to the selected text content item, and thus the effects added in this embodiment are beneficial to listeners who listen to the output speech.

Effects to be added to a text content item by the effect determination unit 2 will be described using specific examples below. Here, as a matter of course, embodiments of the present invention are not limited to the following specific examples.

As an example in which effects are added to a text content item, when the text content item is a received e-mail message, the user information includes, for example, sender information of the e-mail message and user information of a subject portable telephone terminal and the date-and-time information includes, for example, the current date and time and a reception date and time of the received e-mail message. Here, the sender information of the e-mail message is practically an e-mail address; however, if a name or the like related to the e-mail address is registered in a phonebook inside the subject portable telephone terminal, the name can be used as the sender information.

That is, if a user commands that the received e-mail message be read aloud and output using text-to-speech conversion, the effect determination unit 2 obtains, for example, the user information of the subject portable telephone terminal from the user-information recording memory 4 and the current date-and-time information from the date-and-time recording unit 5. Using the user information and the current date-and-time information, the effect determination unit 2 generates text data representing a message for a user of the subject portable telephone terminal and text data representing the current date and time. At the same time, the effect determination unit 2 generates text data representing the name of a sender and text data representing the reception date and time of the received e-mail message from the data of the received e-mail message received by an e-mail reception unit, not shown, and recorded in the text-content recording memory 3. The effect determination unit 2 generates text data to be used to add an effect by combining these pieces of text data as necessary. More specifically, for example, in a case where the name of a user of the subject portable telephone terminal is "A", the current time falls within a "night" time frame, the name of a sender is "B", and an e-mail reception date and time is "April 8 6:30 p.m.", the effect determination unit 2 generates, as an example, text data such as "Good evening, Mr. A. You got mail from Mr. B at 6:30 p.m." as text data to be used to add an effect. Thereafter, the effect determination unit 2 adds the above-described text data to be used to add an effect to, for example, the top of the text data of the title and body of the received e-mail message, and sends resulting text data to the text-to-speech conversion and playback unit 7.

At the same time, the effect determination unit 2 obtains the BGM data set in advance for the content of the e-mail message or BGM data set randomly, from the BGM recording memory 6. Here, for example, the BGM data set in advance for the content of the e-mail message may be set in advance for a name registered in a phonebook, may be set in advance for a reception folder, may be set in advance for a sub-reception folder set by group, or may be set randomly. The effect determination unit 2 sends the BGM data obtained from the BGM recording memory 6 to the BGM playback unit 8.

Thus, the speech obtained as a result of mixing performed by the mixer unit 9 and finally output from the speaker 11 is speech in which speech converted from the text data "Good evening, Mr. A. You got mail from Mr. B at 6:30 p.m." being used an effect and subsequent speech converted from text data of the title and body of the received e-mail message, as described above, and the BGM being used as an effect are mixed.

As another example in which effects are added to the text content item, if the text content item is news downloaded from the Internet or the like, user information is, for example, the user information of a subject portable telephone terminal and date-and-time information includes, for example, the current date and time and a reception date and time of the news distributed.

That is, when a user commands that the news be read aloud using text-to-speech conversion and output, for example, the effect determination unit 2 obtains the user information of the subject portable telephone terminal from the user-information recording memory 4, and obtains the current date-and-time information from the date-and-time recording unit 5. Using the user information and the date-and-time information, the effect determination unit 2 generates text data representing a message for the user of the subject portable telephone terminal and text data representing the current date and time. Moreover, at the same time, the effect determination unit 2 generates text data representing topics of the news and text data representing the distribution date and time of each news topic from the data of the news that is distributed and downloaded through the Internet connection unit, not shown, and recorded in the text-content recording memory 3. Then, the effect determination unit 2 generates text data to be used to add an effect by combining these pieces of text data as necessary. More specifically, for example, in a case where the name of a user of the of the subject portable telephone terminal is "A", the current time falls within a "morning" time frame, a topic of the news is "gasoline tax", and the distribution date and time of the news is "April 8 9:00 a.m.", the effect determination unit 2 generates, as an example, text data such as "Good morning, Mr. A. This is 9 a.m. news regarding gasoline tax" as text data to be used to add an effect. Thereafter, the effect determination unit 2 adds the above-described text data to be used to add an effect to, for example, the top of the text data of the body of the news, and sends resulting text data to the text-to-speech conversion and playback unit 7. Moreover, in a case where an anthropomorphic fictional character "C" or the like that is capable of reading news aloud is set, as an example, text data such as "Newscaster C will report today's news" may be added as text data to be used to add an effect.

Moreover, at the same time, the effect determination unit 2 reads the BGM data set in advance for the content of the news or BGM data set randomly, from the BGM recording memory 6. Here, for example, the BGM data set in advance for the content of the news may be set in advance for the news, may be set in advance for a genre or distribution source of news, or may be set randomly. The effect determination unit 2 sends the BGM data read from the BGM recording memory 6 to the BGM playback unit 8.

Thus, the speech obtained as a result of mixing performed by the mixer unit 9 and finally output from the speaker 11 is speech in which speech converted from the text data "Good morning, Mr. A. This is 9 a.m. news regarding gasoline tax" being used as an effect and subsequent speech converted from text data of the body of the news, as described above, and the BGM being used as an effect are mixed.

As another example in which effects are added to the text content item, if the text content item is a cooking recipe, for example, the user information is the user information of a subject portable telephone terminal and the date-and-time information includes the current date and time and various time periods specified in the cooking recipe.

That is, when a user commands that the cooking recipe be read aloud and output using text-to-speech conversion, for example, the effect determination unit 2 obtains user information of the subject portable telephone terminal from the user-information recording memory 4 and obtains the current date-and-time information from the date-and-time recording unit 5. Using the user information and the date-and-time information, the effect determination unit 2 generates text data representing a message for the user of the subject portable telephone terminal and text data representing the current date and time. Moreover, at the same time, the effect determination unit 2 generates text data representing the name of a dish and text data representing a cooking process for the dish from the data of the cooking recipe recorded in the text-content recording memory 3. Then, the effect determination unit 2 generates text data to be used to add an effect by combining these pieces of text data as necessary. More specifically, for example, in a case where the name of a user of the subject portable telephone terminal is "A", the current time falls within a "daylight" time frame, and the name of a dish is "hamburger steak", the effect determination unit 2 generates, as an example, text data such as "Hello, Mr. A. Let's cook a delicious hamburger steak" as text data to be used to add an effect. Thereafter, the effect determination unit 2 adds the above-described text data to be used to add an effect to, for example, the top of the text data of the cooking process for the dish, and sends resulting text data to the text-to-speech conversion and playback unit 7. Moreover, in particular, in a case where it is necessary to measure time in the middle of cooking such as the roasting time of a hamburger steak, the effect determination unit 2 measures the time. Moreover, in a case where an anthropomorphic fictional character "C" or the like that is capable of reading a cooking recipe aloud is set, as an example, text data such as "My name is C. I'm going to show you how to make a delicious hamburger steak" may be added as text data to be used to add an effect.

At the same time, the effect determination unit 2 reads BGM data set in advance for the content of the cooking recipe or BGM data set randomly, from the BGM recording memory 6. Here, for example, the BGM data set in advance for the content of the cooking recipe may be set in advance for the cooking recipe, may be set in advance for a genre of cooking, or may be set randomly. The effect determination unit 2 sends the BGM data read from the BGM recording memory 6 to the BGM playback unit 8.

Thus, the speech obtained as a result of mixing performed by the mixer unit 9 and finally output from the speaker 11 is speech in which speech converted from the text data "Hello, Mr. A. Let's cook a delicious hamburger steak" being used as an effect and subsequent speech converted from text data of the cooking process for the dish, as described above, and the BGM being used as an effect are mixed.

Here, in the embodiment of the present invention, various effects can be added to a text content item by the effect determination unit 2 other than the above-described specific examples. In order to reduce redundancy, description of other effects is omitted.

Moreover, in this embodiment, while text of a text content item is being read aloud using text-to-speech conversion, for example, if a command or the like is vocally input by a user, reading of the text aloud is paused, restarted, terminated, or repeated, or skipping to and reading of text of another text content item aloud is performed in accordance with the command vocally input by the user. That is, the speech recognition and user command determination unit 10 performs so-called speech recognition on speech input through a microphone or the like, determines details of the command input by the user using the speech recognition result, and sends the details of the input command to the effect determination unit 2. The effect determination unit 2 determines which one of pause, restart, termination, and repeat of reading text of a text content item aloud, skipping to and reading of text of another text content item aloud, and the like is commanded, and performs processing corresponding to the command.

Figure 2:
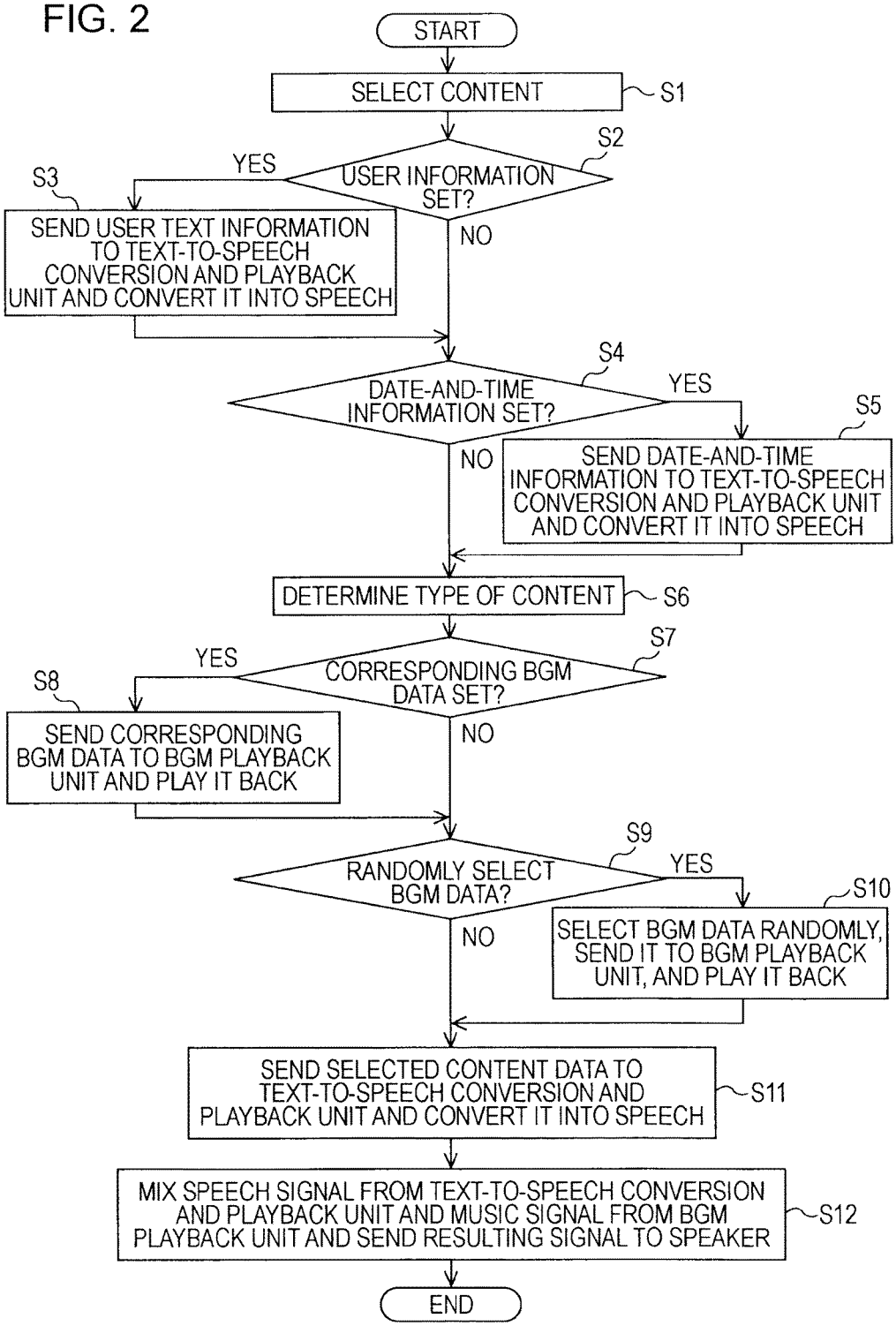
FIG. 2 is a flowchart showing a procedure of processes from selection of a text content item to addition of effects to the text content item.

FIG. 2 shows a procedure of processes from selection of a text content item to addition of effects to the text content item in a portable telephone terminal according to an embodiment of the present invention. Here, the processes of the flowchart shown in FIG. 2 are processes to be performed by a speech synthesis program according to an embodiment of the present invention, the speech synthesis program being executed by the effect determination unit 2.

In FIG. 2, the effect determination unit 2 is in a waiting state until the effect determination unit 2 receives an input from the content-selection interface unit 1 after the speech synthesis program is started. In step S1, when a selection command for selecting a text content item is input by a user through the content-selection interface unit 1, the effect determination unit 2 reads the text content item corresponding to the selection command from the text-content recording memory 3.

Next, in step S2, the effect determination unit 2 determines whether user information related to the text content item is set within the user-information recording memory 4. If the effect determination unit 2 determines that such user information is set, the procedure proceeds to step S3. If the effect determination unit 2 determines that such user information is not set, the procedure proceeds to step S4.

In step S3, as described above, the effect determination unit 2 sends text data corresponding to the user information to the text-to-speech conversion and playback unit 7 so as to convert the text data into speech.

In step S4, the effect determination unit 2 determines whether date-and-time information related to the text content item is set in the date-and-time recording unit 5. If the effect determination unit 2 determines that such date-and-time information is set, the procedure proceeds to step S5. If the effect determination unit 2 determines that such date-and-time information is not set, the procedure proceeds to step S6.

In step S5, as described above, the effect determination unit 2 sends text data corresponding to the date-and-time information to the text-to-speech conversion and playback unit 7 so as to convert the text data into speech.

In step S6, the effect determination unit 2 determines, for example, the type of text content item and the procedure proceeds to step S7.

In step S7, the effect determination unit 2 determines whether BGM data related to the type of text content item is set in the BGM recording memory 6. If the effect determination unit 2 determines that such BGM data is set, the procedure proceeds to step S8. If the effect determination unit 2 determines that such BGM data is not set, the procedure proceeds to step S9.

In step S8, as described above, the effect determination unit 2 reads the BGM data from the BGM recording memory 6 and sends the BGM data to the BGM playback unit 8 so as to play back the BGM data.

In step S9, the effect determination unit 2 determines whether BGM is set to be randomly selected. If the effect determination unit 2 determines that random selection is set, the procedure proceeds to step S10. If the effect determination unit 2 determines that random selection is not set, the procedure proceeds to step S11.

In step S10, the effect determination unit 2 randomly selects BGM data from the BGM recording memory 6 and sends the BGM data to the BGM playback unit 8 so as to play back the BGM data.

In step S11, the effect determination unit 2 sends the text data of the text content item to the text-to-speech conversion and playback unit 7 so as to convert the text data into speech.

Thereafter, in step S12, the effect determination unit 2 causes a speech signal obtained by converting text into speech as described above at the text-to-speech conversion and playback unit 7 to be output to the mixer unit 9. At the same time, the effect determination unit 2 causes a BGM signal played back by the BGM playback unit 8 to be output to the mixer unit 9. Thus, the mixer unit 9 mixes the speech signal converted from text and the BGM signal, and the mixed speech is output from the speaker 11.

The above-described pieces of user information, pieces of date-and-time information, text content items, and pieces of BGM data may be stored in, for example, a server and the like on a network.

Figure 3:
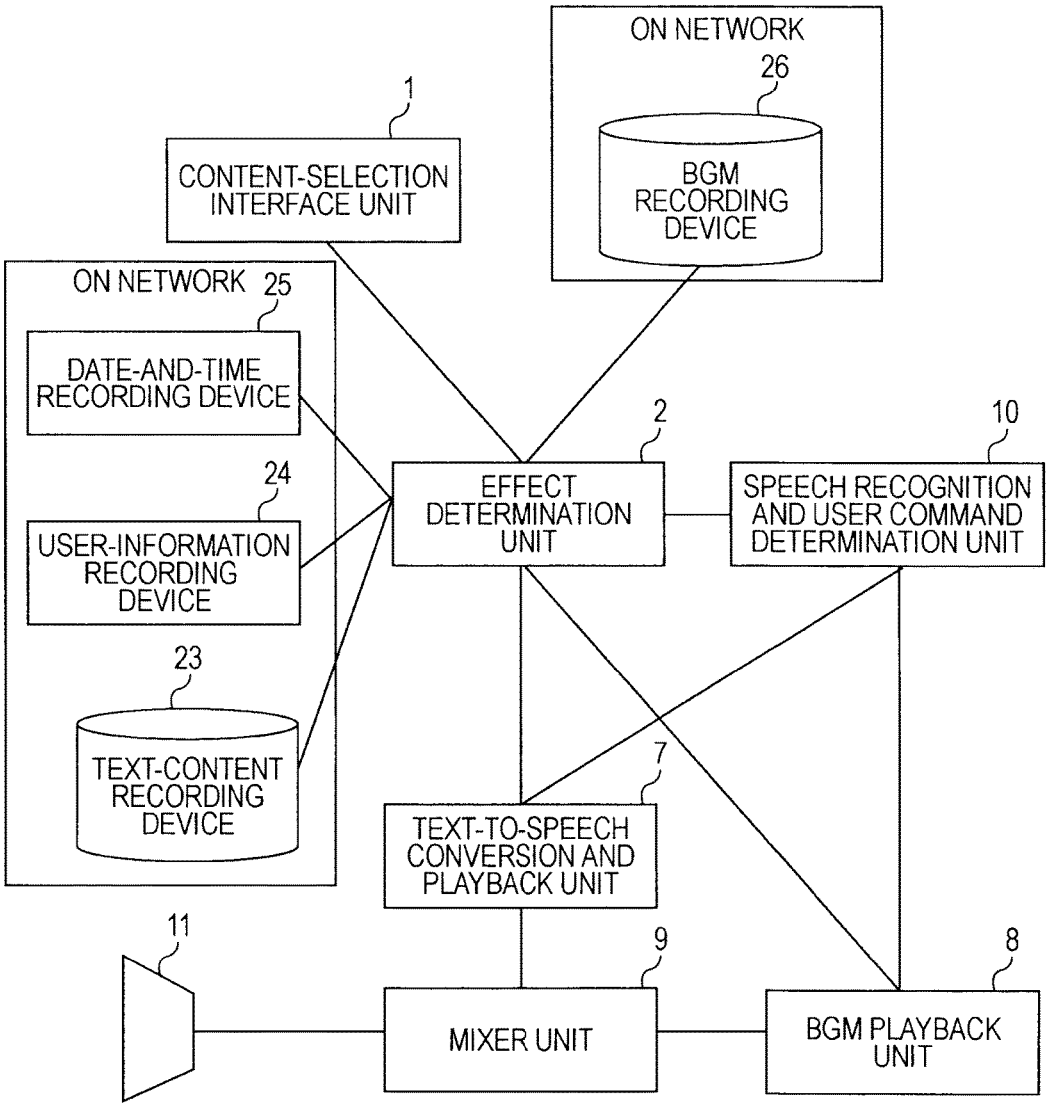
FIG. 3 is a block diagram showing an example of a schematic internal structure of a speech synthesis apparatus in a case where pieces of user information, pieces of date-and-time information, text content items, pieces of BGM data, and the like are stored in a server and the like on a network.

FIG. 3 shows an example of a schematic internal structure of a speech synthesis apparatus in a case where such information is stored on a network. Here, in FIG. 3, the same components as those in FIG. 1 are denoted by the same reference numerals and description thereof will be omitted as necessary.

In a case of an exemplary structure of FIG. 3, a portable telephone terminal as an example of a speech synthesis apparatus according to an embodiment of the present invention includes the content-selection interface unit 1, the effect determination unit 2, the text-to-speech conversion and playback unit 7, the BGM playback unit 8, the mixer unit 9, the speech recognition and user command determination unit 10, and the speaker or headphone 11. That is, in a case of the exemplary structure of FIG. 3, text content items are stored in a text-content recording device 23 on a network. Similarly, pieces of user information related to the text content items are stored in a user-information recording device 24 on the network, and pieces of date-and-time information related to the text content items are stored in a date-and-time recording device 25 on the network. Moreover, pieces of BGM data are stored in a BGM recording device 26 on the network. The text-content recording device 23, the user-information recording device 24, the date-and-time recording device 25, and the BGM recording device 26 include, for example, a server and can be connected to the effect determination unit 2 via a network interface unit which is not shown.

In the exemplary structure of FIG. 3, processing for selecting a text content item, adding effects to the text content item, converting the text content item with effects into a speech signal, and mixing the speech signal and BGM is similar to that described in the above-described examples of FIGS. 1 and 2. Here, in this example of FIG. 3, the exchange of data between the effect determination unit 2 and each of the text-content recording device 23, the user-information recording device 24, the date-and-time recording device 25, and the BGM recording device 26 is performed through the network interface unit.

Here, in a case where the content of a web page on the Internet is obtained, the effect determination unit 2 can determine the type of content obtainable from the web page on the basis of information included in, for example, the URL (uniform resource locator) of the web page. When selecting BGM, the effect determination unit 2 can select BGM corresponding to the type of content. For example, in a case of news web pages, characters such as "news" and the like are often described in the URLs of the web pages. Thus, when characters such as "news" and the like are detected in the URL of a web page, the effect determination unit 2 determines that the content of the web page is included in a news genre. Then, when obtaining BGM data from the BGM recording device 26, the effect determination unit 2 selects BGM data set in advance and related to the content of the news. Furthermore, the type of content may be determined from characters (news and the like) and the like described on the web page instead of the URL.

Moreover, in general, on an Internet browser screen, URLs are often registered in folders set by genre (so-called bookmark folders). Thus, in a case where the content of a web page on the Internet is obtained, the effect determination unit 2 can determine the genre of content obtainable from a web page by monitoring which folder contains the URL of the web page.

For example, mixing of speech obtained as a result of text-to-speech conversion and BGM may be realized by mixing, in the air, speech output from a speaker for outputting speech obtained as a result of text-to-speech conversion and music output from a speaker for outputting BGM.

That is, for example, if speech obtained as a result of text-to-speech conversion is output from, for example, a speaker of a portable telephone terminal and BGM is output from, for example, a speaker of a home audio system, the speech and the BGM are mixed in the air.

In a case of this example, the portable telephone terminal includes at least the content-selection interface unit, the effect determination unit, and the text-to-speech conversion and playback unit. Here, pieces of date-and-time information, pieces of user information, and text content items may be recorded in the portable telephone terminal as shown in the example of FIG. 1, or may be stored on a network as shown in the example of FIG. 3.

In contrast, the BGM recording device and the BGM playback device may be components of, for example, a home audio system. Here, pieces of BGM data may be recorded in the portable telephone terminal and BGM data selected as described above may be transferred from the portable telephone terminal to the BGM playback device of the home audio system via, for example, wireless communication or the like.

Furthermore, for example, a portable telephone terminal may only include the content-selection interface unit and the effect determination unit, and the text-to-speech conversion and playback device performs text-to-speech conversion. A speech signal supplied from the text-to-speech conversion and playback device and a BGM playback music signal supplied from the BGM playback device of the home audio system may be mixed by a mixer device of the home audio system and a resulting signal may be output from the speaker of the home audio system.

As described above, according to the embodiments of the present invention, when a command to read aloud a text content item is input, the user information, date-and-time information, and BGM information related to the text content item are selected. Using the user information, date-and-time information, and BGM information, effects are added to speech converted from the text content item, whereby attractive speech that gives listeners a pleasing impression that speech is not merely converted from subject text can be obtained and output. Moreover, effects added to the text content item are effects based on the user information, date-and-time information, and BGM information related to the text content item, whereby the speech on which effects or the like that are beneficial to a certain level to listeners have been added can be obtained.

Here, the above-described embodiments of the present invention are examples according to the present invention. Thus, the present invention is not limited to the above-described embodiments, and, as a matter of course, various changes according to the design and the like can be made in so far as they are within the scope of the appended claims or the equivalents thereof.

In the above-described embodiments, the language in which a text content item is read aloud is not limited to a specific single language, and may be any of the languages including Japanese, English, French, German, Russian, Arabic, Chinese, and the like.

The present application contains subject matter related to that disclosed in Japanese Priority Patent Application JP 2008-113202 filed in the Japan Patent Office on Apr. 23, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A speech synthesis apparatus comprising:

a receiver that receives an e-mail as a text content item;

a memory that stores the text content item to be converted into speech;

a content selection unit that selects the text content item to be converted into speech based on a vocal command from a user in which the user commands that the received e-mail be read aloud;

a related information selection unit that selects related information which can be at least converted into text and which is related to the text content item selected by the content selection unit, wherein the related information includes at least identification of a sender of the e-mail, and wherein when the name of the sender is locally stored in association with an e-mail address of the sender prior to receipt of the e-mail, the name of the sender is used as the identification of the sender, and when the name of the sender is not locally stored in association with an e-mail address of the sender prior to receipt of the e-mail, the e-mail address is used as the identification of the sender;

a data addition unit that converts the related information selected by the related information selection unit into text by inserting the related information into a predetermined type of phrase to form a text phrase, and adds text data of the text phrase to text data of the text content item selected by the content selection unit, wherein the predetermined type of phrase includes at least one predetermined location within the phrase at which the identification of the sender of the e-mail is inserted;

a text-to-speech conversion unit that converts the text data supplied from the data addition unit into a speech signal; and a speech output unit that outputs the speech signal supplied from the text-to-speech conversion unit.

2. The speech synthesis apparatus according to claim 1, wherein the related information selection unit selects music data related to the selected text content item, and the speech output unit mixes the speech signal supplied from the text-to-speech conversion unit and a music signal of the music data and outputs a resulting signal.

3. The speech synthesis apparatus according to claim 1 or claim 2, wherein the related information selection unit selects the related information which is related to the text content item selected by the content selection unit from among a plurality of pieces of related information which are related to a plurality of text content items capable of being selected by the content selection unit and which are recorded in advance.

4. The speech synthesis apparatus according to claim 1 or claim 2, wherein the content selection unit selects a desired text content item from among a plurality of text content items on a network, and the related information selection unit selects the related information which is related to the text content item selected by the content selection unit from among a plurality of pieces of related information which are related to a plurality of text content items capable of being selected by the content selection unit and which are stored on a network.

5. A speech synthesis method comprising the steps of:

receiving an e-mail as a text content item;

selecting the text content item to be converted into speech, the text content item being selected by a content selection unit based on a vocal command from a user in which the user commands that the received e-mail be read aloud;

selecting related information which can be at least converted into text and which is related to the text content item selected by the content selection unit, the related information being selected by a related information selection unit, wherein the related information includes at least identification of a sender of the e-mail, and wherein when the name of the sender is locally stored in association with an e-mail address of the sender prior to receipt of the e-mail, the name of the sender is used as the identification of the sender, and when the name of the sender is not locally stored in association with an e-mail address of the sender prior to receipt of the e-mail, the e-mail address is used as the identification of the sender;

converting the related information selected by the related information selection unit into text by inserting the related information into a predetermined type of phrase to form a text phrase, and adding text data of the text phrase to text data of the text content item selected by the content selection unit, the conversion and addition being performed by a data addition unit, wherein the predetermined type of phrase includes at least one predetermined location within the phrase at which the identification of the sender of the e-mail is inserted;

converting text data supplied from the data addition unit into a speech signal, the conversion being performed by a text-to-speech conversion unit; and outputting the speech signal supplied from the text-to-speech conversion unit, the speech signal being output by a speech output unit.

6. The speech synthesis method according to claim 5, further comprising the steps of:

selecting music data related to the selected text content item, the music data being selected by the related information selection unit; and mixing the speech signal supplied from the text-to-speech conversion unit and a music signal of the music data and outputting a resulting signal, the mixing and outputting being performed by the speech output unit.

7. A non-transitory computer readable storage medium that stores a speech synthesis program, which when executed by a computer, causes the computer to function as:

a receiver that receives an e-mail as a text content item;

a content selection unit that selects the text content item to be converted into speech based on a vocal command from a user in which the user commands that the received e-mail be read aloud;

a related information selection unit that selects related information which can be at least converted into text and which is related to the text content item selected by the content selection unit, wherein the related information includes at least identification of a sender of the e-mail, and wherein when the name of the sender is locally stored in association with an e-mail address of the sender prior to receipt of the e-mail, the name of the sender is used as the identification of the sender, and when the name of the sender is not locally stored in association with an e-mail address of the sender prior to receipt of the e-mail, the e-mail address is used as the identification of the sender;

a data addition unit that converts the related information selected by the related information selection unit into text by inserting the related information into a predetermined type of phrase to form a text phrase, and adds text data of the text phrase to text data of the text content item selected by the content selection unit, wherein the predetermined type of phrase includes at least one predetermined location within the phrase at which the identification of the sender of the e-mail is inserted;

a text-to-speech conversion unit that converts text data supplied from the data addition unit into a speech signal; and a speech output unit that outputs the speech signal supplied from the text-to-speech conversion unit.

8. The non-transitory computer readable storage medium according to claim 7, wherein the related information selection unit selects music data related to the selected text content item, and the speech output unit mixes the speech signal supplied from the text-to-speech conversion unit and a music signal of the music data and outputs a resulting signal.

9. A portable information terminal comprising:

a receiver that receives an e-mail as a text content item;

a command input unit that obtains a vocal command input by a user;

a content selection unit that selects the text content item to be converted into speech in accordance with the command input by the user in which the user commands that the received e-mail be read aloud;

a related information selection unit that selects related information which can be at least converted into text and which is related to the text content item selected by the content selection unit, wherein the related information includes at least identification of a sender of the e-mail, and wherein when the name of the sender is locally stored in association with an e-mail address of the sender prior to receipt of the e-mail, the name of the sender is used as the identification of the sender, and when the name of the sender is not locally stored in association with an e-mail address of the sender prior to receipt of the e-mail, the e-mail address is used as the identification of the sender;

a data addition unit that converts the related information selected by the related information selection unit into text by inserting the related information into a predetermined type of phrase to form a text phrase, and adds text data of the text phrase to text data of the text content item selected by the content selection unit, wherein the predetermined type of phrase includes at least one predetermined location within the phrase at which the identification of the sender of the e-mail is inserted;

a text-to-speech conversion unit that converts text data supplied from the data addition unit into a speech signal; and a speech output unit that outputs the speech signal supplied from the text-to-speech conversion unit.

10. The portable information terminal according to claim 9, wherein the related information selection unit selects music data related to the selected text content item, and the speech output unit mixes the speech signal supplied from the text-to-speech conversion unit and a music signal of the music data and outputs a resulting signal.

11. A speech synthesis system comprising:

a receiver that receives an e-mail as a text content item;

a selection and addition apparatus that selects the text content item to be converted into speech in accordance with a vocal command input by a user, selects related information which can be at least converted into text and which is related to the selected text content item, converts the selected related information into text by inserting the related information into a predetermined type of phrase to form a text phrase, and adds text data of the text phrase to text data of the selected text content item in accordance with the command input by the user in which the user commands that the received e-mail be read aloud;

a text-to-speech conversion apparatus that converts the text data supplied from the selection and addition apparatus into a speech signal; and a speech output apparatus that outputs, into the air, speech corresponding to the speech signal supplied from the text-to-speech conversion apparatus, wherein the related information includes at least identification of a sender of the e-mail, wherein when the name of the sender is locally stored in association with an e-mail address of the sender prior to receipt of the e-mail, the name of the sender is used as the identification of the sender, and when the name of the sender is not locally stored in association with an e-mail address of the sender prior to receipt of the e-mail, the e-mail address is used as the identification of the sender, and wherein the predetermined type of phrase includes at least one predetermined location within the phrase at which the identification of the sender of the e-mail is inserted.

12. The speech synthesis system according to claim 11, wherein the selection and addition apparatus selects music data related to the selected text content item, and the speech output apparatus mixes the speech signal supplied from the text-to-speech conversion apparatus and a music signal of the music data and outputs speech according to a mixed speech signal.

13. The speech synthesis system according to claim 11, wherein the selection and addition apparatus selects a music signal related to the selected text content item, and the speech output apparatus includes a device that outputs, into the air, speech according to the speech signal supplied from the text-to-speech conversion apparatus and a device that outputs, into the air, music according to the music signal supplied from the selection and addition apparatus.

14. The speech synthesis apparatus according to claim 1, wherein the related information further includes at least one of a time relating to the text content item, a subject of the text content item, and a current time.

15. The speech synthesis apparatus according to claim 1, wherein the text phrase includes a salutation.

16. The speech synthesis apparatus according to claim 15, wherein the salutation is determined based on a current time.

17. A speech synthesis apparatus comprising:

a processor;

a network interface unit that receives an e-mail as a text content item to be converted into speech from an external device;

a command input unit that obtains a vocal command input by a user;

a content selection unit that selects the text content item to be converted into speech in accordance with the command input by the user in which the user commands that the received e-mail be read aloud;

a related information selection unit, implemented by the processor, that selects related information which can be at least converted into text and which is related to the text content item received by the network interface unit, wherein the related information includes at least identification of a sender of the e-mail, and wherein when the name of the sender is locally stored in association with an e-mail address of the sender prior to receipt of the e-mail, the name of the sender is used as the identification of the sender, and when the name of the sender is not locally stored in association with an e-mail address of the sender prior to receipt of the e-mail, the e-mail address is used as the identification of the sender;

a data addition unit that converts the related information selected by the related information selection unit into text by inserting the related information into a predetermined type of phrase to form a text phrase, and adds text data of the text phrase to text data of the received text content item, wherein the predetermined type of phrase includes at least one predetermined location within the phrase at which the identification of the sender of the e-mail is inserted;

a text-to-speech conversion unit that converts the text data supplied from the data addition unit into a speech signal; and a speech output unit that audibly outputs the speech signal supplied from the text-to-speech conversion unit.

* * * * *